US008432772B2

(12) United States Patent
Meis

(10) Patent No.: US 8,432,772 B2
(45) Date of Patent: Apr. 30, 2013

(54) CHRONOGRAPH

(75) Inventor: Reinhard Meis, Stockach (DE)

(73) Assignee: Montblanc-Simplo GmbH, Hambrug (DE)

( * ) Notice: Subject to any disclaimer, the term of this patent is extended or adjusted under 35 U.S.C. 154(b) by 195 days.

(21) Appl. No.: 12/685,786

(22) Filed: Jan. 12, 2010

(65) Prior Publication Data

US 2010/0182878 A1 Jul. 22, 2010

(30) Foreign Application Priority Data

Jan. 21, 2009 (CH) ..... 00088/09

(51) Int. Cl.
*G04B 25/00* (2006.01)

(52) U.S. Cl.
USPC ..... 368/71; 368/76

(58) Field of Classification Search ..... 368/81, 368/69–71, 76, 80
See application file for complete search history.

(56) References Cited

U.S. PATENT DOCUMENTS

| | | | | | |
|---|---|---|---|---|---|
| 253,338 | A * | 2/1882 | Audemars | 368/104 |
| 394,933 | A * | 12/1888 | Piquet | 368/102 |
| 426,396 | A * | 4/1890 | Schlatter | 368/102 |
| 550,182 | A * | 11/1895 | Lecoultre | 368/102 |
| 552,715 | A * | 1/1896 | Lugrin | 368/102 |
| 5,122,995 | A * | 6/1992 | Vuilleumier | 368/102 |
| 6,196,713 | B1 * | 3/2001 | Meis et al. | 368/190 |
| 6,842,403 | B2 * | 1/2005 | Meis | 368/110 |

FOREIGN PATENT DOCUMENTS

| | | | |
|---|---|---|---|
| DE | 1673837 | A1 | 1/1971 |
| DE | 4209580 | A1 | 9/1993 |
| DE | 10135110 | A1 | 2/2003 |
| EP | 1491972 | A1 | 12/2004 |
| EP | 1584997 | A2 | 10/2005 |

* cited by examiner

*Primary Examiner* — Sean Kayes
(74) *Attorney, Agent, or Firm* — Blank Rome LLP

(57) ABSTRACT

A chronograph with a chronograph driving mechanism through which a chronograph hand staff of a chronograph hand can be driven in rotation, with a rattrapante hand staff, arranged coaxially to the chronograph hand staff, of a first rattrapante hand that can be driven in superimposed position with the chronograph hand. The chronograph hand staff and rattrapante hand staff are connected to one another in locked-rotation, wherein the rotation of the rattrapante hand staff can be blocked in order to display a split time. A second rattrapante hand is connected frictionally with a second rattrapante hand staff arranged coaxially to the chronograph hand staff. The chronograph hand and the second rattrapante hand can be driven in movement synchronously in superimposed position, wherein the rotation of both rattrapante hand staffs can be blocked independently from one another in order to display two different lap times.

28 Claims, 2 Drawing Sheets

CHRONOGRAPH

BACKGROUND OF INVENTION

1. Related Applications

This application claims priority to Switzerland Application No. 2009/CH0088, filed Jan. 21, 2009, which is hereby incorporated in its entirety by reference.

2. Field of the Invention

The invention relates to a chronograph according to the independent claim. Advantageous embodiments arise from the subclaims.

3. Background of the Related Art

The relevant state of the art comprises in particular chronographs that have a rattrapante function. In this case, the rattrapante mechanism is mostly used for intermittently stopping the chronograph hand during the time measurement, whilst the measuring process is still running, and then to have it jump forwards to the total measured time. This is for instance the case in order to allow the elapsed time to that point (split time) to be read easily whilst the total elapsed time still continues being recorded.

Such a chronograph with only one rattrapante hand is known from DE4209580A1. In this known chronograph, after starting, the chronograph hand and the rattrapante hand can be stopped again together by activating a first actuator. It is also possible with a second actuator to stop only the rattrapante hand whilst the chronograph hand continues to run. This allows split times within a minute to be measured. When the second actuator is activated again, the rattrapante hand jumps to the position of the running chronograph hand and continues to run together with it, being ready for a renewed measuring of a split time. Measuring split times is possible as often as desired but the last measured split time is always lost. If one also wishes to stop the chronograph hand, the first actuator needs to be activated. There are thus two states of the standing hand. Either both hands are one above the other or each hand has its own position. This means that only two times are continuously visible through the position of the standing hands.

DE1673837 concerns a stopwatch provided with a rattrapante in which the rattrapante is borne by a pin passing through a tube and is supported by an elastically stressed hammer and a heart.

EP1584997 refers to a chronograph with a movement whose seconds' chronograph hand and, in a number especially of thirty steps per rotation, whose minutes' chronograph hand can be driven in rotation, with a control device for stopping the seconds' chronograph hand and the minutes' chronograph hand that has a trigger element for starting and stopping the seconds' chronograph hand and of the minutes' flyback hand.

EP1491972A1 pertains to a watch, in particular a wristwatch, with an analog time display that has at least a minutes' hand and an hours' hand. The watch is further provided with a rattrapante mechanism having at least a minutes' rattrapante hand and/or hours' rattrapante hand placed coaxially to the hands of the normal time display. In a normal mode of the watch, the rattrapante hand or hands are moved synchronously with the hands of the time display and in superposed position relative thereto, while in a time-measuring mode it/they can be halted to mark any point in time and be brought back afterwards with the hands of the normal time display to an superposed position relative thereto. The frictional coupling of the rattrapante mechanism is preferably arranged non-coaxially to the axis of the watch's motion train.

DE10135110A1 relates to a chronograph having a chronograph gear through which, when a first actuator is manually activated, a chronograph hand staff of a chronograph can be driven in rotation, and having also, coaxially to the chronograph hand staff, a rattrapante hand staff of a rattrapante hand that can be driven in superposed fashion with the chronograph hand. There is on the chronograph hand staff a seconds' heart for resetting the chronograph hand, the chronograph hand staff and the rattrapante hand staff being connected in locked-rotation to one another through a rattrapante heart cam with a frictional coupling. On the rattrapante hand staff, there is a rattrapante wheel that can be hugged by the gripper arms of a rattrapante gripper while under spring preload and whose rotation can be blocked through friction-locking or form-fitting. Furthermore, there is a switch element that is moved by manually activating a second actuator between a locked position and a released position and that allows the gripper arms to be moved removably from their rotation movement by the rattrapante hand.

SUMMARY OF THE INVENTION

One aim of the invention is to create a chronograph of the aforementioned kind that allows a differentiated measuring option than is possible with the chronographs known in the state of the art.

Another aim of the invention is to make visible the beginning and end of three events within a process simultaneously for one recording, so that when all three hands stand, three times are lastingly available for recording.

These aims are achieved according to the invention with an embodiment of a chronograph according to the preamble of the independent claim in that a second rattrapante hand is provided, which is connected frictionally with a second rattrapante hand staff arranged coaxially to the chronograph hand staff, wherein chronograph hands and the second rattrapante hand can be driven in movement synchronously in superimposed position and wherein the rotation of both rattrapante hand staffs can be blocked independently from one another in order to display two different lap times.

Because of the fact that on the chronograph hand staffs there are two coaxial rattrapante hand staffs, independent from one another, with one rattrapante hand each, both rattrapante hands after starting together can be stopped independently from one another and it is thus advantageously possible with the inventive chronograph to have two different lap times displayed. The present invention advantageously allows a dynamic tolerance measurement during which only the first rattrapante hand is stopped and it is seen whether an external event occurs within a time span that is being measured with the second rattrapante hand. All further events are measured within the tolerance between both rattrapante hands only with the chronograph hand. This advantageously increases the possibilities of using the inventive chronograph.

Advantageously, the chronograph hand staff is perforated and accommodates the first rattrapante staff. The second rattrapante hand staff is also perforated and accommodates the chronograph hand staff, so that both rattrapante staffs are arranged on both sides of a movement of the chronograph.

In order to keep the distances of the chronograph hand and of both rattrapante hands as low as possible, the normal motion train of the chronograph for the clock time is located outside the chronograph hand staffs.

On each of the rattrapante hand staffs, rattrapante wheels can also advantageously be placed that can be hugged by the dedicated gripper arms of both rattrapante grippers while under spring preload and whose rotation can be locked through friction-locking or form-fitting, where the respective gripper arms can be moved removably by the respective rattrapante wheel through manually activating an actuator and can be held by the gripper arms through a movable column wheel in a blocking position and in a final blocking position. Both rattrapante grippers can be placed on the movement side or on the dial side.

Further advantageous embodiments are indicated in the subclaims.

BRIEF DESCRIPTION OF THE FIGURES

Examples of representations of the invention are given in the drawing and are more closely described hereinafter. The figures show.

DETAILED DESCRIPTION OF THE PREFERRED EMBODIMENTS

Figure 1:
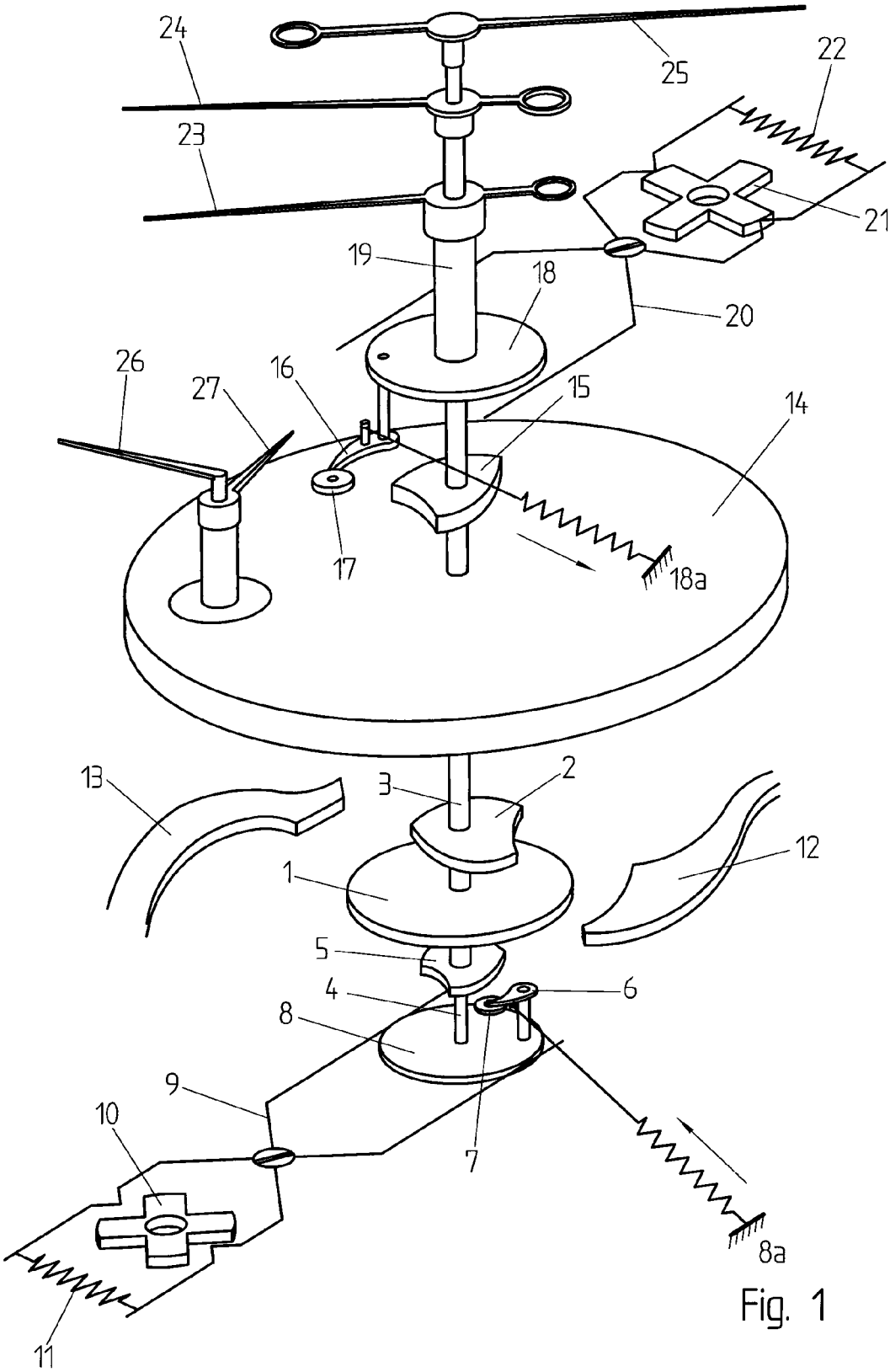
FIG. 1 a view of the inventive construction of the two rattrapante-mechanisms on a chronograph hand staff.

FIG. 1 shows the construction of a motion train of an inventive chronograph 33, in particular a wristwatch, with two rattrapante hands 23, 25 arranged independently from one another. A chronograph hand staff 3 bears, on the dial side, the chronograph center hand 24. A chronograph center wheel 1 and a heart-shaped return-to-zero controller 2 are fastened on the chronograph hand staff 3. A blocking cam 12, which gears into the chronograph center wheel 1, and a return-to-zero hammer lever 13, that communicates with the heart-shaped return-to-zero controller 2, serve to reset the chronograph center hand 24. The chronograph hand staff 3 is completely perforated and accommodates a first rattrapante staff 4 with the rattrapante wheel 8, which is connected frictionally on the dial side with the first rattrapante hand 25. The staff 3 bears in locked-rotation a rattrapante heart cam 5 beneath the chronograph center wheel 1.

The staff 3 and the first rattrapante staff 4 are connected to one another in locked-rotation with a frictional coupling through the first rattrapante heart cam 5 and the spring-loaded hammer 6 with its return-to-zero controller roll 7, so that both hands can be driven synchronously and superimposed over one another. In the outer radial area of the rattrapante wheel 8, the rattrapante hammer 6 is articulated by one of its extremities so that it can be pivoted around an axis parallel to the chronograph hand staff 3. This rattrapante hammer 6 can be pivoted in the same plane in which the rattrapante heart cam 5 is located. By means of a hammer spring, the free extremity of the rattrapante hammer 6 is forced into abutment, by way of a coupling surface, against the encircling lateral surface of the rattrapante heart cam 5. The hammer spring is fastened on one extremity to the fastening point 8*a* that is on the rattrapante wheel 8. In order to enhance comprehensibility, this fastening point is not represented exactly in FIG. 1.

If the rattrapante wheel 8 can be rotated freely, then the rattrapante hammer 6 slides along the lateral surface of the rattrapante heart cam 5 until the lateral surface is positioned next to the chronograph hand staff 3 and, in this position, couples the rattrapante wheel 8 and chronograph hand staff 3 to one another in a force-fitting manner. When the chronograph hand staff 3 is driven in rotation, the rattrapante hand staff 4 is rotated along synchronously over the frictional coupling of the rattrapante hammer 6, so that the chronograph hand 24 and the first rattrapante hand 25 move together as if connected to one another.

If, as the chronograph hand staff 3 is being driven, the rattrapante wheel 8 is blocked, the rattrapante hammer 6 through tensioning of its hammer spring slides along the lateral surface of the rattrapante heart cam 5 by way of its roll, with the result that the first rattrapante hand 25 remains stationary, while the chronograph hand 24 continues turning. When the blocking of the rattrapante wheel 8 is eliminated, the rattrapante hammer 6 slides along the lateral surface of the rattrapante heart cam 5 until it is positioned next to the chronograph hand staff 3, in order then to continue rotating synchronously with the first chronograph hand staff 3.

In order to block the rotating movement of the rattrapante wheel 8, the latter is encompassed by the free ends of the gripper arms of an approximately u-shaped first rattrapante gripper 9, so that a form-fitting connection between the rattrapante wheel 8 and the gripper arms can be established. The rattrapante gripper 9 can be opened and closed by means of gripper arms on the other end independently with an actuating element by means of a combined switching and column wheel 10, working against a spring 11 that is tensed between both gripper arms. Said actuating element for actuating the combined switching and column wheel 10 at the outer edge of the watch's housing remains freely accessible to the user in order to trigger the corresponding stopwatch function of the first rattrapante hand 25 of the chronograph. When activating the actuating element a second time, the split time is cancelled and the first rattrapante hand 25 continues to run again with the chronograph center hand 24 through the mentioned mechanism.

The chronograph hand staff 3 according to the invention bears on the dial side a second rattrapante hand staff 19, on which a second rattrapante hand 23 is fastened on the dial side and a rattrapante wheel 18 is fastened on the dial side. The second rattrapante hand staff 19 itself is completely perforated and accomodates the chronograph hand staff 3. On the chronograph hand staff 3, a second rattrapante heart cam 15 is also affixed in locked-rotation and engages with the rattrapante wheel 18 over the hammer 16 with its return-to-zero controller roll 17 in a frictional coupling together. The mechanism of frictional coupling and uncoupling between both staffs 3, 19 corresponds to the mechanism described above for the first rattrapante staff 4. In the outer radial area of the rattrapante wheel 18, the rattrapante hammer 16 is articulated by one of its extremities so that it can be pivoted around an axis parallel to the chronograph hand staff 3. This rattrapante hammer 16 can be pivoted in the same plane in which the rattrapante heart cam 15 is located. By means of a tension spring, the free extremity of the rattrapante hammer 16 is forced into abutment, by way of a coupling surface, against the encircling lateral surface of the rattrapante heart cam 15. The hammer spring is fastened on one extremity to the fastening point 18*a* that is on the rattrapante wheel 18. In order to enhance comprehensibility, this fastening point is not represented exactly in FIG. 1.

If the rattrapante wheel 18 can be rotated freely, then the rattrapante hammer 16 slides along the lateral surface of the rattrapante heart cam 15 until the lateral surface is positioned next to the chronograph hand staff 3 and, in this position, couples the rattrapante wheel 18 and chronograph hand staff 3 to one another in a force-fitting manner. When the chronograph hand staff 3 is driven in rotation, the second rattrapante hand staff 19 is rotated along synchronously over the frictional coupling of the rattrapante hammer 16, so that the chronograph hand 24 and the second rattrapante hand 23 move together as if connected to one another.

If, as the chronograph hand staff 3 is being driven, the rattrapante wheel 18 is blocked, the rattrapante hammer 16 through tensioning of its hammer spring slides along the lateral surface of the rattrapante heart cam 15 by way of its coupling surface, with the result that the second rattrapante hand 23 remains stationary, while the chronograph hand 24 continues turning. When the blocking of the rattrapante wheel 18 is eliminated, the rattrapante hammer 16 slides along the lateral surface of the rattrapante heart cam 15 until it is positioned next to the chronograph hand staff 3, in order then to continue rotating synchronously with the first chronograph hand staff 3.

In order to block the rotating movement of the rattrapante wheel 18, the latter is encompassed by the free ends of the gripper arms of an approximately u-shaped second rattrapante gripper 20, so that a form-fitting connection between the rattrapante wheel 18 and the gripper arms can be established. The rattrapante gripper 20 can be opened and closed by means of gripper arms on the other end independently with a second actuating element by means of a combined switching and column wheel 21, working against a spring 22 that is tensed between both gripper arms. Said second actuating element at the outer edge of the watch's housing also remains freely accessible to the user in order to trigger the corresponding stopwatch function of the second rattrapante hand 23 of the chronograph. When activating the second actuating element a second time, the split time is cancelled and the second rattrapante hand 23 continues to run again with the chronograph center hand 24.

Because of the fact that on the chronograph hand staff 3 there are two coaxial rattrapante hand staffs 4, 19, independent from one another, with one rattrapante hand 23, 25 each, both rattrapante hands 23, 25 after starting together can be stopped independently from one another and it is thus advantageously possible with the inventive chronograph to have two different lap times displayed.

The present invention advantageously also allows a dynamic tolerance measurement during which only the first rattrapante hand is stopped and it is seen whether an external event occurs within a time span that is being measured with the second rattrapante hand. All further events are measured within the tolerance between both rattrapante hands 23, 25 only with the chronograph hand 24. For this, the chronograph hand 24 is reset to zero whilst both rattrapante hands 23, 25 remain on the originally measured position. This advantageously increases the possibilities of using the inventive chronograph.

Figure 2:
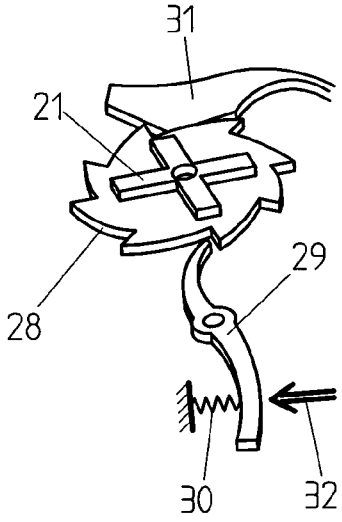
FIG. 2 an example of embodiment for a combination of ratchet wheel and column wheel with a jumper spring and the actuating element loaded through a spring, that can be activated through the actuating element.

In FIG. 2, an embodiment of a combination of switching wheel 28 and column wheel 10, 21 with a detent spring 31 and the switching element 29 loaded through a spring 30, which is activated through the actuating element 32, is represented symbolically. This example of embodiment can be used in the frame of the invention for the combined switching wheel 28 and column wheels 10, 21 shown in FIG. 1.

Figure 3:
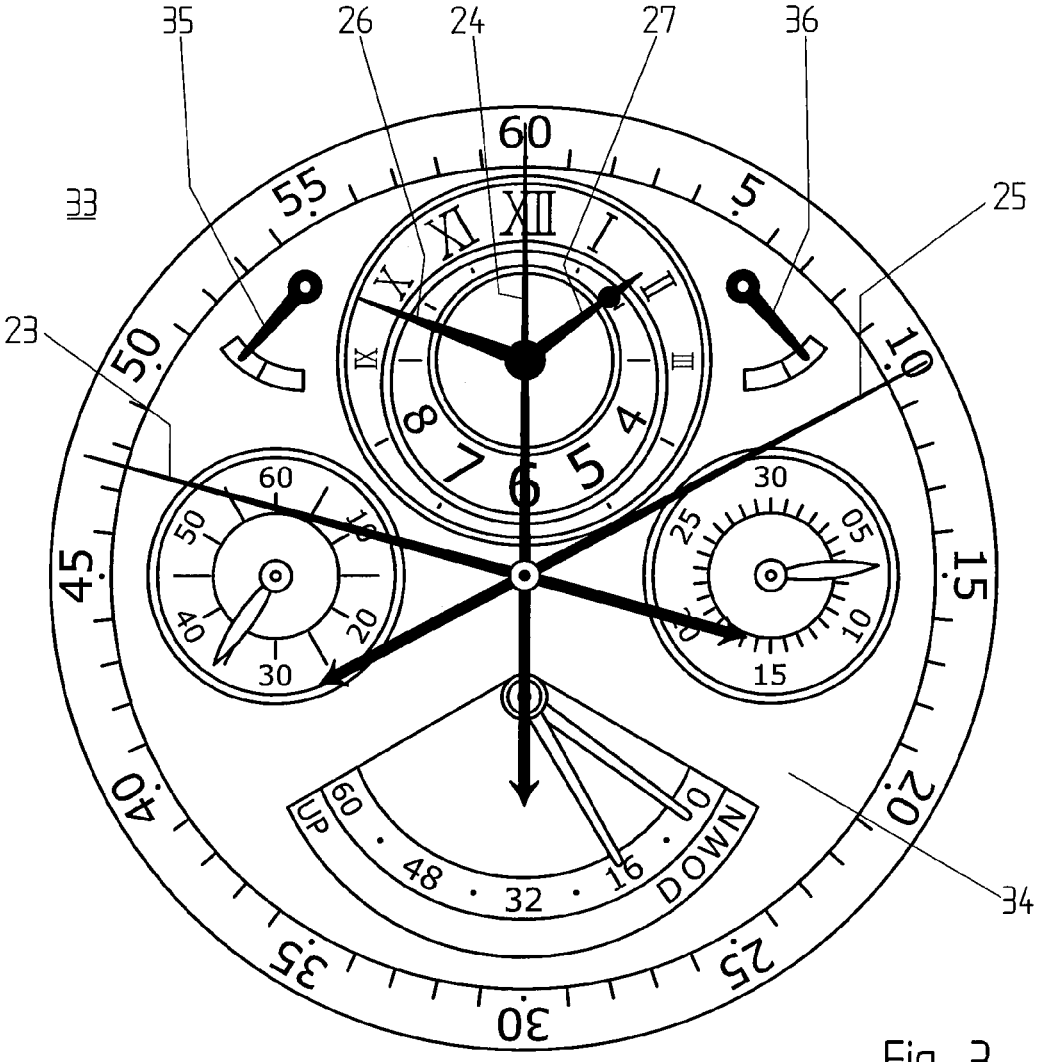
FIG. 3 an overall view of an inventive chronograph with dial and a display of the halting states of both rattrapante hands in order to know, when starting, whether the grippers are closed or open.

FIG. 3 shows an overall view of an inventive chronograph 33 with a dial 34. As can be seen in FIG. 3, the halting states of both rattrapante hands 23, 25 can be made visible through displays 35, 36. By reading the displays 35, 36, the user can thus know, when starting, whether the grippers 9, 20 are closed or open. In order to keep the distances of the chronograph hand 24 and of both rattrapante hands 23, 25 as low as possible, the normal motion train for the clock time, consisting of the minutes' hand 26 and the hours' hand 27, is located outside the chronograph hand staff 3.

LIST OF REFERENCES

1 Chronograph center wheel
2 Heart-shaped return-to-zero controller
3 Chronograph hand staff
4 Rattrapante staff
5 Rattrapante heart cam
6 Hammer
7 Return-to-zero controller roll
8 Rattrapante wheel
8*a* Fastening point
9 Rattrapante gripper
10 Column wheel
11 Spring
12 Blocking cam
13 Return-to-zero hammer
14 Movement
15 Rattrapante heart cam
16 Hammer
17 Return-to-zero controller roll
18 Rattrapante wheel
18*a* Fastening point
19 Rattrapante staff
20 Rattrapante gripper
21 Column wheel
22 Spring
23 Rattrapante hand
24 Chronograph center hand
25 Rattrapante hand
26 Minutes' hand
27 Hours' hand
28 Switching wheel
29 Switching element
30 Spring
31 Detent spring
32 Actuating element
33 Chronograph
34 Dial
35 Display of the halting state of the rattrapante hand 23
36 Display of the halting state of the rattrapante hand 25

The invention claimed is:

1. A chronograph comprising:

a dial, a chronograph hand staff that can be driven in rotation, connected with a chronograph hand, a first rattrapante hand staff, arranged coaxially to the chronograph hand staff, connected with a first rattrapante hand, wherein the chronograph hand and the rattrapante hand can be driven in movement synchronously in a superimposed position and wherein the rotation of the rattrapante hand staff can be blocked in order to display, together with the rattrapante hand a first lap time, and a second rattrapante hand staff, connected with a second rattrapante hand, arranged coaxially to the chronograph hand staff, wherein the chronograph hand and the second rattrapante hand can be driven in movement synchronously in a superimposed position, wherein the rotation of the second rattrapante hand staff can be blocked independently from the first rattrapante hand staff in order to display with the second rattrapante hand a second lap time, and a rattrapante gripper associated with each rattrapante hand, said gripper being actionable by way of an activating element to selectively either block or release a rattrapante wheel associated with the corresponding rattrapante hand staff, such that, while the chronograph hand is running, each of the first and second rattrapante hands can be released from a blocked position to continue to run synchronously with said chronograph hand in a superimposed position.

2. The chronograph according to claim 1, wherein the chronograph hand staff is perforated and accommodates the first rattrapante to hand staff and the second rattrapante hand staff is perforated and accommodates the chronograph hand staff.

3. The chronograph according to claim 1, wherein the said first and second rattrapante hand staffs are arranged on both sides of a movement of the chronograph.

4. The chronograph according to claim 1, wherein the chronograph hand staff and both rattrapante hand staffs can be connected to one another in locked-rotation with a frictional coupling, each through one rattrapante heart c fixedly fastened on the chronograph hand staff.

5. The chronograph according to claim 1, wherein on each of the rattrapante hand staffs, the rattrapante wheels is positioned such that said wheel can be hugged by gripper arms of the corresponding rattrapante gripper while under spring preload, whereby the rotation of the rattrapante wheel can be locked through friction-locking or form-fitting.

6. The chronograph according to claim 5, wherein the gripper arms can be held through a movable column wheel in a blocking position and in a final blocking position.

7. The chronograph according to claim 6, wherein by manually activating an actuating element of the chronograph, the column wheel can be moved and the respective gripper arms can accordingly release the corresponding rattrapante wheel.

8. The chronograph according to claim 6, wherein the column wheel is combined with a switching wheel.

9. The chronograph according to claim 5, wherein both rattrapante grippers are placed on the movement side or on the dial side.

10. The chronograph according to claim 5, wherein on the dial the halting states of both rattrapante hands can be made visible through a display in order to know, when starting, whether the grippers are closed or open.

11. The chronograph according to clam 1, wherein on the chronograph hand staff there is a seconds' heart for resetting the chronograph hand.

12. The chronograph according to clam 1, wherein the motion work and minutes' wheel of the chronograph are placed outside the chronograph hand staff.

13. The chronograph according to claim 1, wherein the chronograph is embodied in a wristwatch.

14. A chronograph comprising:

a dial, a chronograph hand staff that can be driven in rotation, connected with a chronograph hand, a rattrapante hand staff, arranged coaxially to the chronograph hand staff, connected with a first rattrapante hand, wherein the chronograph hand and the rattrapante hand can be driven in movement synchronously in superimposed position and wherein the rotation of the rattrapante hand staff can be blocked in order to display, together with the rattrapante hand a lap time, wherein a second rattrapante hand staff, connected with a second rattrapante to hand, arranged coaxially to the chronograph hand staff, wherein the chronograph hand and the second rattrapante hand can be driven in movement synchronously in superimposed position, wherein the rotation of the second rattrapante hand staff can be blocked independently from the first rattrapante hand staff in order to display with the second rattrapante hand a cumulative lap time, and wherein said first and second rattrapante hand staffs are arranged on both sides of a movement of the chronograph.

15. The chronograph according to claim 14, wherein the chronograph hand staff is perforated and accommodates the first rattrapante hand staff and the second rattrapante hand staff is perforated and accommodates the chronograph hand staff.

16. The chronograph according to claim 14, wherein the chronograph hand staff and both rattrapante hand staffs can be connected to one another in locked-rotation with a frictional coupling, each through one rattrapante heart cam fixedly fastened on the chronograph hand staff.

17. The chronograph according to claim 14, wherein on each of the rattrapante hand staffs, rattrapante wheels are placed that can be hugged by the dedicated gripper arms of a rattrapante gripper while under spring preload and whose rotation can be locked through friction-locking or form-fitting.

18. The chronograph according to claim 17, wherein the gripper arms can be held through a movable column wheel in a blocking position and in a final blocking position.

19. The chronograph according to claim 18, wherein by manually activating an actuating element of the chronograph, the column wheel can be moved and the respective gripper arms can accordingly be moved removably by the respective rattrapante wheel.

20. The chronograph according to claim 18, wherein the column wheel is combined with a switching wheel.

21. The chronograph according to claim 17, wherein both rattrapante grippers are placed on the movement side or on the dial side.

22. The chronograph according to claim 17, wherein on the dial the halting states of both rattrapante hands can be made visible through display in order to know, when starting, whether the grippers are closed or open.

23. The chronograph according to claim 14, wherein on the chronograph hand staff there is a seconds' heart for resetting the chronograph hand.

24. The chronograph according to claim 14, wherein the motion work and minutes' wheel of the chronograph are placed outside the chronograph hand staff

25. The chronograph according to claim 14, wherein the chronograph is executed as wristwatch.

26. A chronograph comprising:

a dial, a chronograph hand staff that can be driven in rotation, connected with a chronograph hand, a rattrapante hand staff, arranged coaxially to the chronograph hand staff, connected with a first rattrapante hand, wherein the chronograph hand and the rattrapante hand can be driven in movement synchronously in superimposed position and wherein the rot ion of the rattrapante hand staff can be blocked in order to display, together with the rattrapante hand a lap time, and a second rattrapante hand staff, connected with a second rattrapante hand, arranged coaxially to the chronograph hand staff, wherein the chronograph hand d the second rattrapante hand can be driven in movement synchronously in superimposed position , wherein the rotation of the second rattrapante hand staff can be blocked independently from the first rattrapante hand staff in order to display with the second rattrapante hand a cumulative lap time, and wherein the first and second rattrapante hands can be restarted again, from their stopped posit on, after having being stopped , and after the chronograph hand has be reset, to continue to run again with said chronograph hand, wherein the said first and second rattrapante hand staffs are ranged on both sides of a movement of the chronograph.

27. A chronograph comprising:

a dial, a chronograph hand staff that can be driven in rotation, connected with a chronograph hand, a rattrapante hand staff, arranged coaxially to the chronograph hand staff, connected with a first rattrapante hand, wherein the chronograph hand and the rattrapante hand can be driven in movement synchronously in superimposed position and wherein the rotation of the rattrapante hand staff can be blocked in order to display, together with the rattrapante hand a lap time, and a second rattrapante hand staff, connected with a second rattrapante hand, arranged coaxially to the chronograph hand staff, wherein the chronograph further comprises, a movement;

a center wheel which is configured to pivot on the movement and is fixed to chronograph hand staff ;

a first rattrapante wheel which is configured to pivot n the movement and is fixed to first rattrapante hand staff ;

a second rattrapante wheel which is configured to pivot on the movement and is fixed to second rattrapante hand staff ;

wherein the chronograph hand and the second rattrapante hand can be driven in movement synchronously in superimposed position, the rotation of the second rattrapante hand staff can be blocked independently from the first rattrapante hand staff in order to display with the second rattrapante hand a cumulative lap time, and a rattrapante gripper associated with each rattrapante hand, said gripper being actionable by way of an activating element to selectively either block or release a rattrapante wheel associated with the corresponding rattrapante hand staff, such that, while the chronograph hand is running, each of the first and second rattrapante hands can be released from a blocked position to continue to run synchronously with said chronograph hand in a superimposed position.

28. A chronograph comprising:

a dial, a chronograph hand staff that can be driven in rotation, connected with a chronograph hand, a rattrapante hand staff, arranged coaxially to the chronograph hand staff, connected with a first rattrapante hand, wherein the chronograph hand and the rattrapante hand can be driven in movement synchronously in superimposed position and wherein the rotation of the rattrapante hand staff can be blocked in order to display, together with the rattrapante hand a lap time, and a second rattrapante hand staff, connected with a second rattrapante hand, arranged coaxially to the chronograph hand staff, wherein the chronograph hand and the second rattrapante hand can be driven in movement synchronously in superimposed position , wherein the rotation of the second rattrapante hand staff can be blocked independently from the first rattrapante hand staff in order to display with the second rattrapante hand a cumulative lap time, and a rattrapante gripper associated with each rattrapante hand, said gripper being actionable by way of an activating element to selectively either block or release a rattrapante wheel associated with the corresponding rattrapante hand staff, such that, while the chronograph hand is running, each of the first and second rattrapante hands can be released from a blocked position to continue to run synchronously with said chronograph hand in a superimposed position.

* * * * *